US005860644A

United States Patent [19]

Takeuchi et al.

[11] Patent Number: 5,860,644

[45] Date of Patent: Jan. 19, 1999

[54] SHEET FEEDING AND STACKING BASE FOR ELECTRONIC PRINTERS

[75] Inventors: Masakazu Takeuchi; Shun Mizutani, both of Tokyo; Kenji Umehara, Yokohama, all of Japan; Bradford Billings, Lake Forest, Calif.

[73] Assignee: Gradco (Japan) Ltd., Tokyo, Japan

[21] Appl. No.: 912,310

[22] Filed: Oct. 23, 1996

[51] Int. Cl.[6] ..... B65H 5/22

[52] U.S. Cl. ..... 271/4.01; 271/298; 271/303; 271/902

[58] Field of Search ..... 271/288, 298, 271/303, 304, 902, 279, 3.14, 3.18, 4.01

[56] References Cited

U.S. PATENT DOCUMENTS

| | | | |
|---|---|---|---|
| 4,639,125 | 1/1987 | Okuda et al. | 271/902 |
| 4,958,828 | 9/1990 | Saito | 271/902 |
| 5,018,714 | 5/1991 | Honjo et al. | 271/902 |
| 5,139,254 | 8/1992 | Yamashita et al. | 271/902 |
| 5,208,640 | 5/1993 | Horie et al. | 271/298 |
| 5,603,494 | 2/1997 | Baker et al. | 271/296 |
| 5,625,860 | 4/1997 | Maeda et al. | 271/288 |

FOREIGN PATENT DOCUMENTS

| | | | |
|---|---|---|---|
| 0086335 | 5/1986 | Japan | 271/298 |
| 0036231 | 2/1987 | Japan | 271/303 |
| 62-96258 | 5/1987 | Japan | 271/303 |
| 0037038 | 2/1988 | Japan | 271/298 |

*Primary Examiner*—H. Grant Skaggs
*Attorney, Agent, or Firm*—Newton H. Lee, Jr.

[57] ABSTRACT

A base cabinet for an electronic printer has facilities for feeding sheets of paper from the base to a printer resting on the base and selectively for a) returning printed sheets to the base for stacking; b) inverting printed sheets exiting the printer and passing them to a receiver; c) passing sheets or envelopes exiting the printer straight through to a receiving tray; and d) feeding sheets exiting the printer upwardly to a sorter or mailbox.

2 Claims, 4 Drawing Sheets

M
T2

P
T1
30
P1
11
R
D
1P
13
H1
P2
19
P3
H2
SR
FR
F
S
B

SHEET FEEDING AND STACKING BASE FOR ELECTRONIC PRINTERS

BACKGROUND OF THE INVENTION

There exists in the marketplace a printer mounted on a base cabinet which contains a sheet feeder for supplementing the sheet capacity of the normal sheet storage and feeding capacity of the printer itself. Such a unit is marketed by Hewlett-Packard as a "LASER-JET" or a 5Si/55 MX Printer" with capacity to utilize various auxiliary devices, for example, to feed envelopes and to collate or separate job output into either a receiving tray or a roll away multi-bin mailbox type stacker.

As a result, such a unit is quite versatile and permits ready printing of various types of jobs. However, the multi-bin mailbox is quite expensive and occupies significant floor space or footprint.

In any case, such printers, with or without auxiliary equipment, as mentioned above, require a support stand, base or table.

For purpose of feeding sheets straight through to a receiving tray for envelopes or large sheets, the above referenced unit has a straight through or by pass paper path leading to a receiving tray located above the space in which the multi-bin sheet receiver may be located and an output feed mechanism must be provided for the receiving tray or the roll up multi-bin unit.

In addition, a simple stacker is known for application to the above referenced printer which is mounted at the outlet side of the base cabinet and feeds sheets from the printer to a box-like receptacle for a large number of sheets. However, such a stacker is used in lieu of the multi-bin device, but, yet, still is an external structure requiring floor space for utilization.

There also is known a multi-bin mailbox type receiver of such construction as to be capable of mounting above and over the top of a printer such as that referenced above, as illustrated in U.S. patent application Ser. No. 557,399, filed Nov. 13, 1995, co-owned herewith.

SUMMARY OF THE INVENTION

An object of the present invention is to provide a base unit for printers of the type referenced above which is versatile in that it contains within the base, below the printer, a supplemental sheet feeding unit, a stacking unit for a large quantity of sheets or envelopes and selective sheet feeding means enabling sheets to be fed downwardly from the printer to either the stacker in the base, below the printer, straight through to the receiving tray, either inverted or not inverted, or upwardly to a mailbox as disclosed in application 557,399, as desired.

Accordingly, the base unit, together with the printer thereon provides a pleasing appearance in a compact space, and wherein increased sheet feeding, stacking, mailboxing or simple receiving capacity is provided, by virtue of the inclusion in the base of a high capacity sheet feeder and a high capacity stacker located beneath the printer.

More specifically the base unit includes an infeed to the printer from the sheet feeder and at the output from the printer the base unit provides a selective sheet feed path mechanism including diverter means and feed means which enable: a) straight through feeding of a sheet or envelope to a receiving tray; b) diversion of a sheet in a downward direction for delivery to a stacker in the base; c) diversion of a sheet downwardly followed by reversal and movement upwardly to the straight through path for inversion of the sheet as it is fed into the receiver tray; or d) upwardly for delivery to an upward feed path to a mailbox or sorter.

All of these functions or sheet feed directions are performed in a very small space and by a small number of parts so that the aesthetically pleasing base can be of reasonable cost.

Other features and advantages of the invention will be hereinafter described or will be recognized by reference to the following description, taken together with the drawings forming a part hereof.

DESCRIPTION OF THE PREFERRED EMBODIMENT

Figure 1:
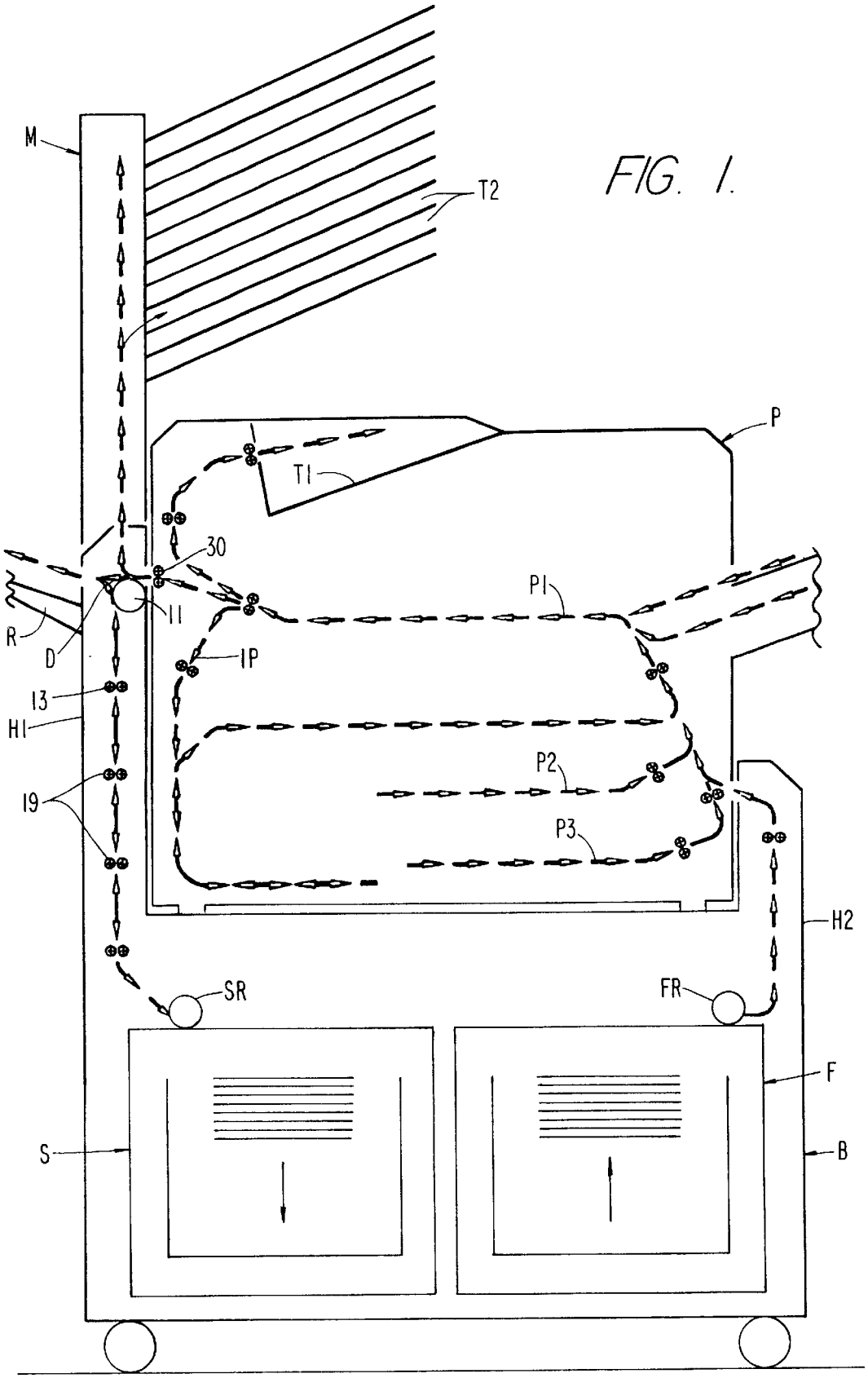
FIG. 1 is a view generally showing the base with a printer mounted thereon and showing the sheet feed path to the printer, through the printer as typical, and in the multiple modes of the invention.

Referring to FIG. 1, apparatus incorporating the invention is illustrated including a base B on which a printer P is supported, the printer being supplied with an auxiliary paper sheet sorting or mailboxing device M and the base having a sheet feeder device F and a sheet stacker device S in the base below the printer, as well as a sheet receiving tray R. Such a combination of base and printer provides a compact combination for handling substantial quantities of sheets of paper, in addition to the normal sheet infeed capacity of the printer, in various modes of operation of the printer.

The sheet feeder F and stacker S are diagrammatically illustrated and may be of various known constructions, the functions of which are to support and move upwardly a tray containing sheets to be fed by a feed roll FR in the direction of the arrow upwardly to the printer, and to support for downward feeding movement, sheets supplied to a stacker table by a feed roll SR from the path indicated by the arrows.

The printer, as illustrated, represents the "Hewlett-Packard, "H.P. 5Si" printer well known in the industry. The printer includes a number of sheet supply sources, including paper trays adapted to contain a stack of plan paper sheets selectively supplied from the respective trays under the control of the printer through paper paths P1, P2 and P3 either to a face down receiving bin or tray T1 on top of the printer, to a receiving tray R straight through the printer, or through a sheet inversion path IP to the receiving tray R or to the top tray.

In accordance with the invention, sheets passing through the printer may also be diverted from the path to the receiving tray R by means of a diverter D to be later described, which can cause sheets to be deflected upwardly to the mailbox M which, as in the case of tray T1, automatically inverts the sheets as they are deposited in receiving trays T2 of the mailbox/sorter M. The diverter D can also deflect sheets downwardly for delivery to stacker S or for reversal and subsequent upward movement for inverted delivery to receiver tray R.

In any event, the stacker S and feeder F are adapted to be enclosed in the base B, below the printer, and to enhance the capacity of the printer P or other such printers which are adapted to be mounted on a table or base and where the desire is to provide additional sheet handling capacity and/or options.

The diverter D and associated feed rollers are incorporated in a housing section H extending upwardly at one side of the base B from the stacker S and its infeed SR, and the feed path from the feed roll FR at the feeder F extends upwardly in a housing section H2 at the other side of the housing, so as to accommodate the printer P between housing sections H and H2.

Referring to FIGS. 2–6, adjacent the upper end of housing H1 is a shaft 10 supporting paper feed rolls 11. Spaced downwardly in housing H from shaft 10 is a shaft 12 supporting paper feed rolls 13.

Figure 6:
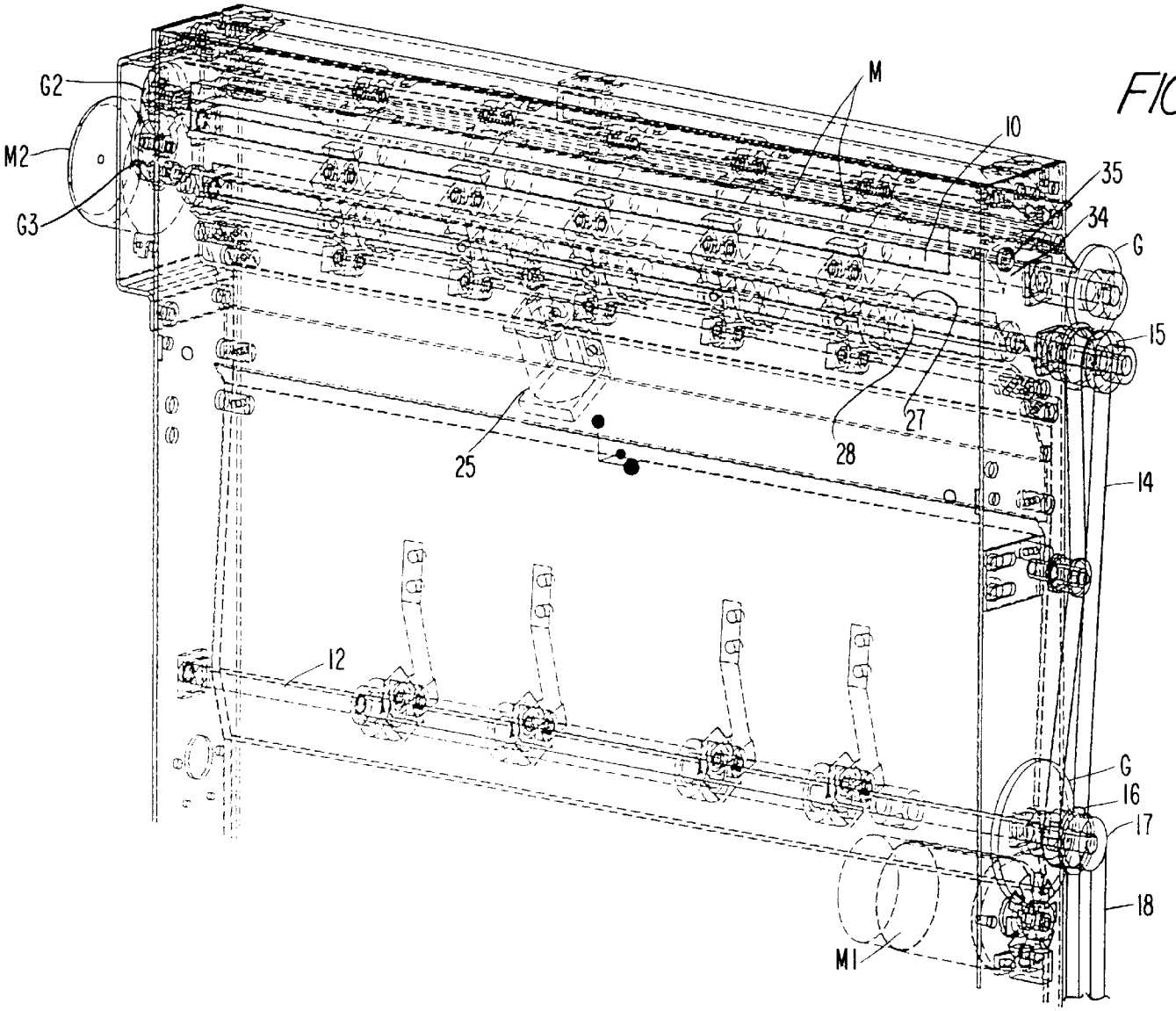
FIG. 6 is an isometric fragmentary view showing the diverter and basic selective feed mechanism of FIGS. 2–5.

Means are provided for driving shafts 10 and 12 in opposite directions and selectively, including a drive motor M1 best seen in FIG. 6, appropriate gearing G and a drive belt 14 extending between drive pulley 15 for driving shaft 10 and pulley 16 for driving shaft 12. Also on shaft 12 is a pulley 17 and a downwardly extending belt 18 which afford a drive for additional downwardly spaced sets of feed rolls 19 (see FIG. 1) as may be required, depending upon the height of housing section H1 so as to direct sheets downwardly to the stacker infeed roll SR.

Associated with the paper feed rolls 13 on shaft 12 are suitable spring loaded pressure rolls 20 adapted to maintain feed pressure as the paper is moved through an appropriate guide 21 either downwardly or upwardly depending upon the functioning of the device.

Figure 2:
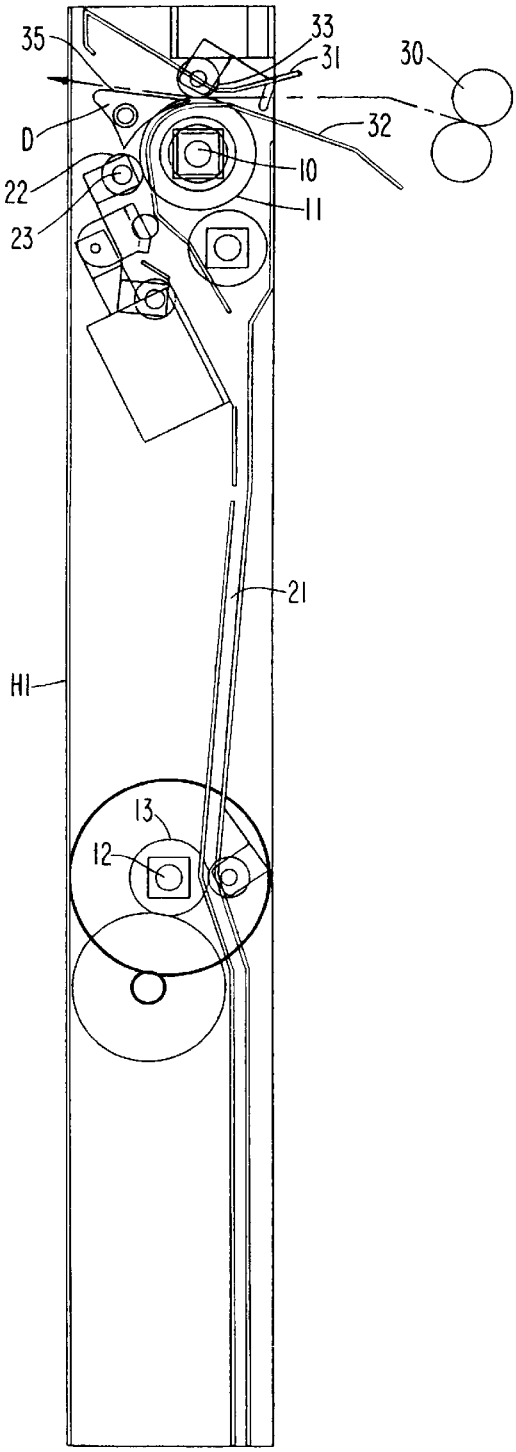
FIG. 2 is a view showing the selective sheet output path from the printer in condition for straight through feed.
Figure 3:
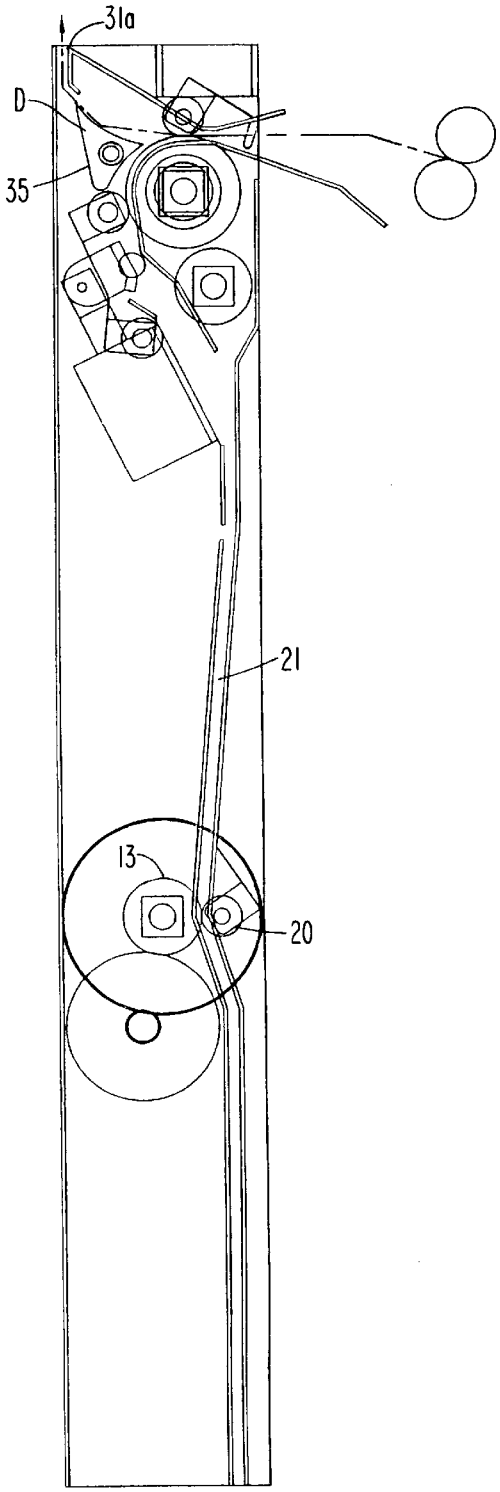
FIG. 3 is a view like FIG. 2 but showing the selective sheet output path in condition for upward feed.
Figure 4:
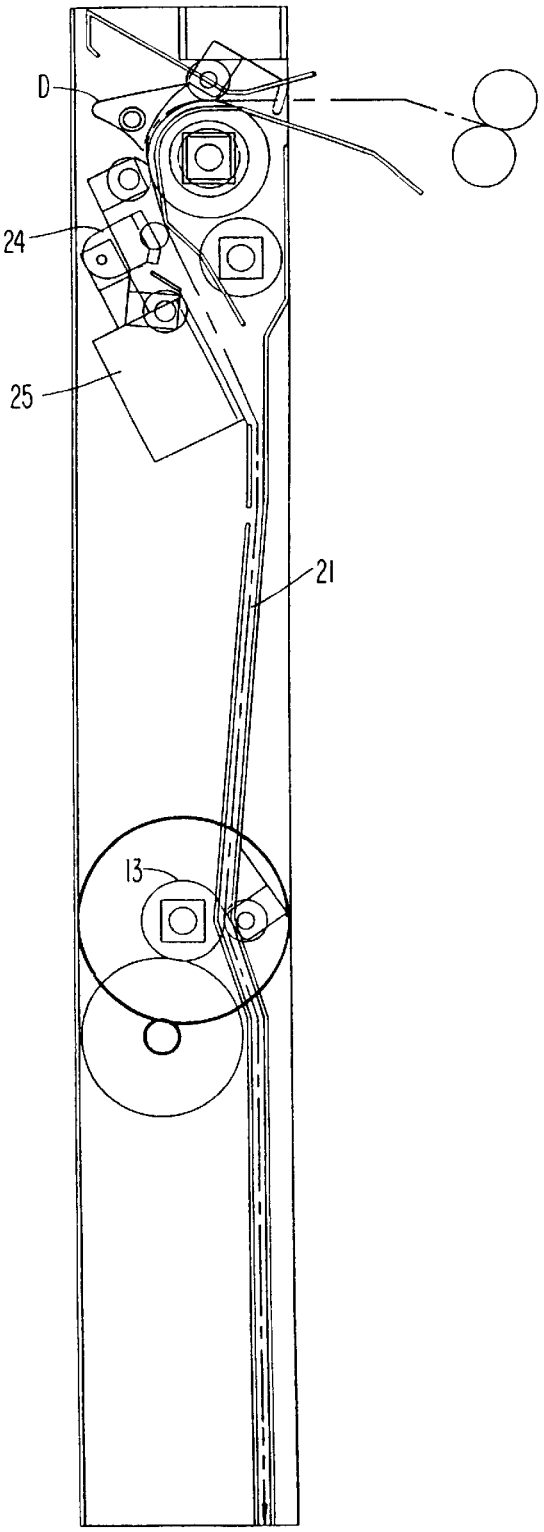
FIG. 4 is a view like FIG. 2 but showing the selective sheet output path in condition for downward feed.
Figure 5:
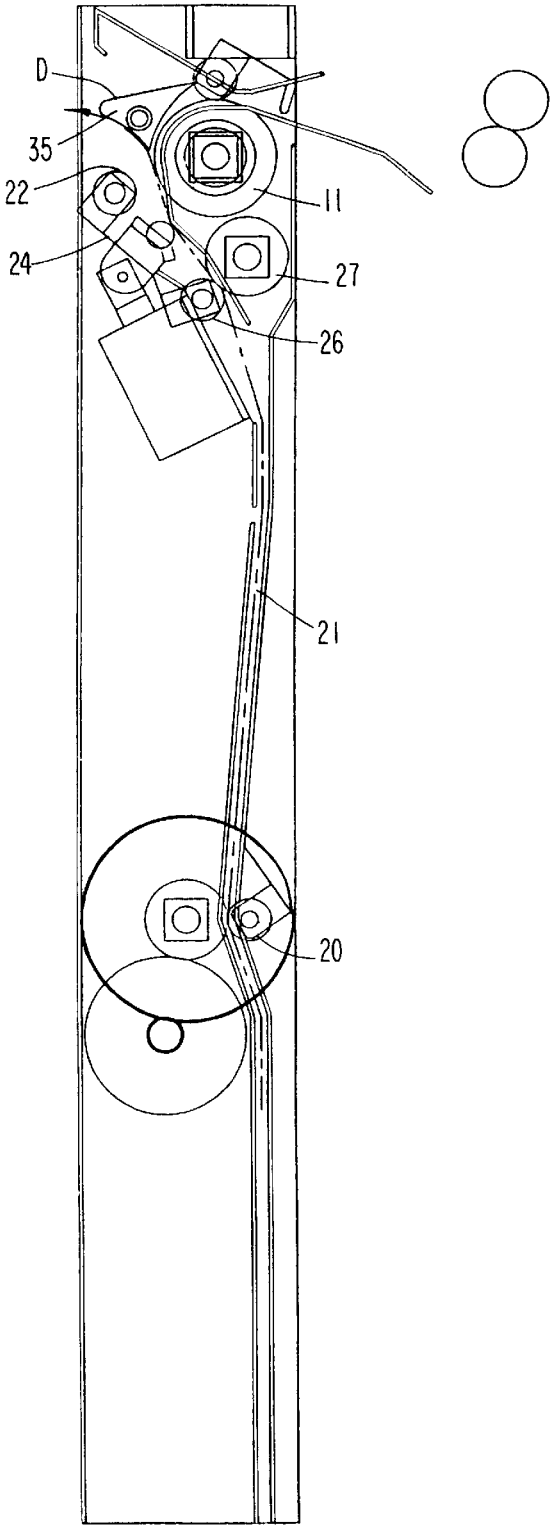
FIG. 5 is a view like FIG. 2 but showing the selective sheet output path in condition for reversal and inverted feed to a receiving tray.

Associated with feed rolls 11 are companion pressure or nip rolls 22 mounted upon a transverse shaft 23 and supported at one end of a pivot arm 24. This arm 24 is connected to the armature of solenoid 25, so that the pivot arm 24 can be shifted between positions, as shown in FIGS. 2, 3 and 4 with the nip roll 22 engaged with the feed rolls 11, and the alternative position, as shown in FIG. 5, with the nip roll 22 removed from engagement with feed rolls 11 and, as shown in FIG. 5, another nip roll 26, at the other end of pivot arm 24, is engaged with a set of driven feed rolls 27 rotatably mounted on a driven shaft 28. Shaft 28 is adapted to be driven by gearing G2 in the opposite sense of rotation of the shaft 10, so that when nip roll 26 engages feed roll 27, reversal or movement of a paper sheet upwardly in the guide 21 is effected.

A pair of output feed rolls 30, as generally indicated in FIG. 1 and each of FIGS. 2 through 5, are adapted to transport a printed paper sheet from the sheet outlet of printer P into the upper end of housing H1 and into the feed path defined by sheet guide plates 31 and 32 for engagement between the paper feed rolls 10 and nip rolls 33 which are suitably supported above the feed rolls 11 so as to define a nip for moving printed sheets between the guide plates 31 and 32.

The direction of sheet feed from between rolls 11 and nip rolls 33, as indicated by the arrows in FIGS. 2 through 5 is determined by positioning of deflector means D previously referred to.

The deflector means D includes a generally triangular deflector member 34 rockable on a shaft 35, see FIG. 6, by means of a stepper motor M2 and appropriate gearing G3. The deflector member 35 is adapted to be pivoted on its rockable support between the first position shown in FIG. 2, in a second position shown in FIG. 3 and a third position shown in both FIGS. 4 and 5. In the first position of the deflector (FIG. 2), as indicated by the arrow, a paper sheet will be fed substantially straight through from the printer output rolls 30 to the feed rolls 11 and nip rolls 33 and to the receiver tray R. For this purpose the one side of the deflector 35 has a relatively flat face extending essentially horizontally when member 35 is in the position of FIG. 2.

Referring to FIG. 3, another side of the deflector member 35 has an arched surface which, when the member 35 is in the position of FIG. 3, provides a curved surface for directing a sheet upwardly as indicated by the arrow, into a transversely extending guide space 31*a* defined between a housing wall and the outer end of guide member 31.

The third face of the triangular member 35 is formed, so that as seen in FIG. 5 the sheet, as indicated by the arrow, will be directed from the housing in an upwardly and outwardly direction, as the direction of sheet travel is reversed from that shown in FIG. 4 and, therefore, the sheet is moving upwardly for inversion and direction into a sheet receiving tray or other external sheet receiving, finishing or stacking apparatus (not shown) which may be in lieu of or in addition to the stacker S shown in FIG. 1.

From the foregoing it will be apparent that the structure of the sheet transporting and diverting means incorporated in the housing side H1 of the base for the printer provides means, at the printed sheet outlet of the printer, for selectively returning printed sheets to the base for stacking, inverting the printed sheets and passing them to a suitable receiver such as the receiver tray R, or other post processing device, or passing the sheets straight through to such a receiver, or feeding the sheets exiting the printer upwardly to a sorter or mailbox M, such as that shown in the prior pending application referred to at the commencement hereof.

We claim:

1. A sheet feeding and printed sheet stacking base unit for supporting thereon a paper sheet printer having a sheet feed path for receiving and transporting sheets through said printer and a sheet outlet for exit from said printer of printed sheets, said printer having sheet feeding means incorporated therein for supplying sheets to said feed path: comprising additional sheet feeder means incorporated within said base beneath said printer for supplying supplemental sheets to said sheet feed path, receiver means provided by said base at one side thereof for receiving printed sheets directly from said sheet outlet and including means for transporting sheets from said sheet outlet to said receiver means, and means for stacking printed sheets exiting said sheet outlet incorporated within said base beneath said printer, means for feeding printed sheets and diverting means for printed sheets from said sheet outlet and interposed between said receiver means and said means for stacking printed sheets for selectively feeding and diverting printed sheets from said outlet to said receiver means or to said means for stacking printed sheets, and also including sheet transporting means extending downwardly from said means for feeding printed sheets to said means for stacking printed sheets, means for reversing said means for feeding printed sheets and for actuating said means for diverting printed sheets for diverting inverted printed sheets to said receiver means.

2. A sheet feeding and printed sheet stacking base unit as defined in claim 1 wherein said means for diverting printed sheets is also operable to divert sheets upwardly from said outlet and including printed sheet sorting means incorporated with said base above said printer for receiving and sorting upwardly diverted printed sheets.

* * * * *